United States Patent [19]

Ishiyama et al.

[11] Patent Number: 4,671,499

[45] Date of Patent: Jun. 9, 1987

[54] TUNDISH FOR CONTINUOUS CASTING OF FREE CUTTING STEEL

[75] Inventors: Kazuo Ishiyama; Masashi Yoshida; Isao Suzuki; Ichiro Kudo; Akira Otaki; Noboru Okuyama, all of Muroran, Japan

[73] Assignee: Nippon Steel Corporation, Tokyo, Japan

[21] Appl. No.: 828,372

[22] Filed: Feb. 11, 1986

[30] Foreign Application Priority Data

Feb. 22, 1985 [JP] Japan ..... 60-23534[U]

[51] Int. Cl.[4] ..... C21B 3/00

[52] U.S. Cl. ..... 266/275; 266/236

[58] Field of Search ..... 266/275, 236, 220, 229, 266/230, 286; 164/337, 335, 437, 438

[56] References Cited

U.S. PATENT DOCUMENTS 4,042,229 8/1977 Eccleston ..... 266/275
4,043,543 8/1977 Courtenay et al. ..... 266/275
4,468,012 8/1984 Daussan et al. ..... 266/275

FOREIGN PATENT DOCUMENTS 48-14524 5/1973 Japan .
54-35715 3/1979 Japan .
54-31035 3/1979 Japan .
54-31013 3/1979 Japan .
54-36574 11/1979 Japan .
59-56562 4/1984 Japan .

*Primary Examiner*—L. Dewayne Rutledge
*Assistant Examiner*—S. Kastler
*Attorney, Agent, or Firm*—Wenderoth, Lind & Ponack

[57] ABSTRACT

A tundish for continuous casting of a free-cutting steel comprises a molten steel teeming zone into which a low melting metal is added to a molten metal as a machinability element, a dispersing means provided in the flow path of the molten steel between the molten steel teeming zone and a discharge outlet for the molten steel, and a dam installed downstream the dispersing means.

6 Claims, 19 Drawing Figures

TUNDISH FOR CONTINUOUS CASTING OF FREE CUTTING STEEL

The present invention relates to a tundish for continuous casting of a molten steel having added thereto Pb or Bi in order to promote the melting and dispersion thereof.

A free-cutting steel is produced by adding a machinability element to the molten steel; Pb, Ca, Bi, etc. are known as machinability elements.

However, there is a great difference between the melting points of Pb and Bi and that of steel, and further, both Pb and Bi have a higher specific gravity than steel. As a result, in continuous casting undissolved Pb or Bi flows from the tundish into the mold and becomes so unevenly distributed in the continuously cast steel that it forms huge inclusions therein, degrading the quality of the continuously cast product.

To deal with this problem, Japan examined patent application (referred to as Kokoku) No. 48(1973)-14524 proposes surrounding the ladle outlet with a dam to prevent the flow of Pb or Bi. Another Japan unexamined utility model application (referred to as Utility Model Kokai) No. 54(1979)-35715 proposes providing the bottom of the tundish with a dam to prevent undissolved alloy and nonmetallic inclusions from flowing into the mold.

According to another Kokai No. 59(1984)-56562, it is proposed to greatly improve the addition yield of Pb by reducing the rate of addition thereof into the ladle so as to remarkably decrease the amount of Pb setting at the bottom of the ladle.

The methods generally used for adding a low melting alloy, a ferro-alloy or the like into the steel melt are that of adding the alloy to the steel melt being discharged from the steel converter and that of adding it directly into the ladle. In another Kokai No. 54(1979)-31013 and the Kokai No. 54(1979)-31035, a shroud is provided over the whole length of the molten steel flow downwardly from the ladle to the tundish and an inflow-pipe is installed at its forward end for introduction of Ca onto the molten steel level in the tundish at an intermediate point of the vertical length of the shroud.

Further in Kokoku No. 54(1979)-36574, a shroud is provided to surround the lower part of the molten steel flowing down from the ladle, and a dam is provided at the lower part thereof as immersed into the molten steel within the tundish. A steel purifying agent is droppingly added within the immersed dam.

A prime object of the present invention is to provide a tundish for use in continuous casting in which undissolved Pb and Bi in the molten steel are prevented from flowing into the mold.

Another object of the invention is to provide a tundish in which the Pb and Bi dissolution yield is greatly improved by forming a large circulating current of the molten steel so as to control the behavior of the Pb and Bi.

In accordance with the present invention, a tundish is provided with a molten steel teeming zone (referred to as teeming zone hereinafter) into which Pb or Bi (referred to as a low melting metal hereinafter) is added. The teeming zone is formed in the middle region of the tundish. A dispersing means which stirs the molten steel so as to promote uniform dispersion of the low melting metal is provided along a runner through which the molten steel runs from the teeming zone to a discharge outlet.

The dispersing means is an ejector provided at the bottom of the tundish from which an inert gas such as Ar, $N_2$ etc. is ejected to stir the molten steel by gas bubbling action.

In addition, at least one dam is provided downstream of the dispersing means in order to prevent the low melting metal from flowing into the discharge outlet for the molten steel.

Figure 1:
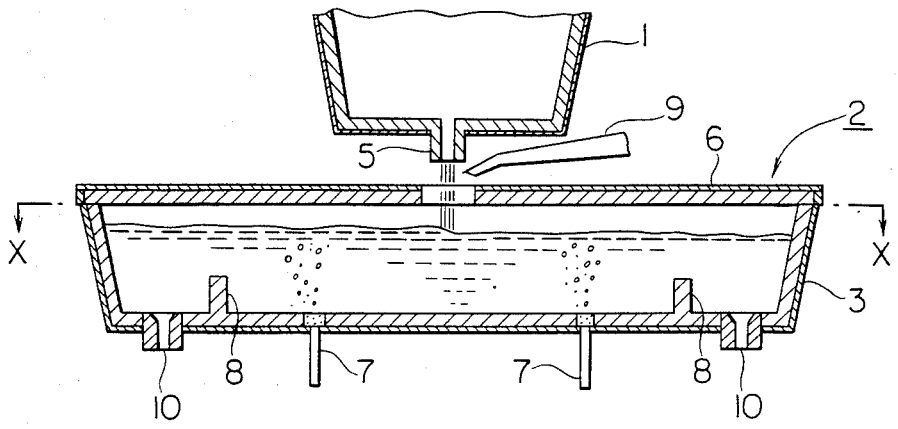
FIG. 1 is a front sectional view showing a typical embodiment of the present invention.
Figure 2:
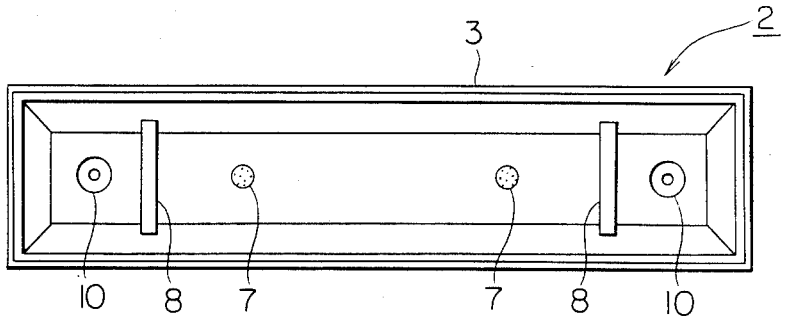
FIG. 2 is a plan view along line X—X of FIG. 1.

In FIGS. 1–2, there are shown a ladle 1, a ladle nozzle 5 and a feed pipe 9 for the low melting metal. The main body 3 of a tundish 2 is provided with a cover 6, and dams 8, 8 are installed downstream in the direction of molten steel flow from gas ejectors 7, 7. The main body 3 is further provided with discharge outlets 10.

A teeming zone is formed immediately below the nozzle 5, and a dispersing zone is formed between the gas ejectors 7, 7 and the dams 8, 8.

Figure 3:
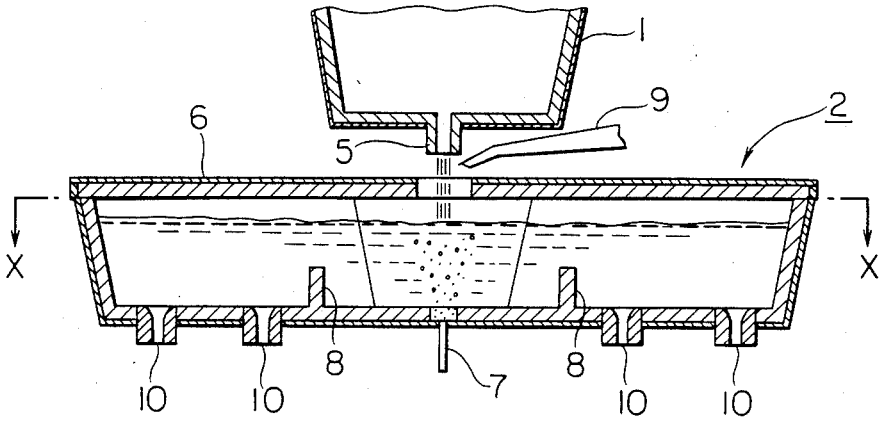
FIG. 3 is a front sectional view of another embodiment of the invention.
Figure 4:
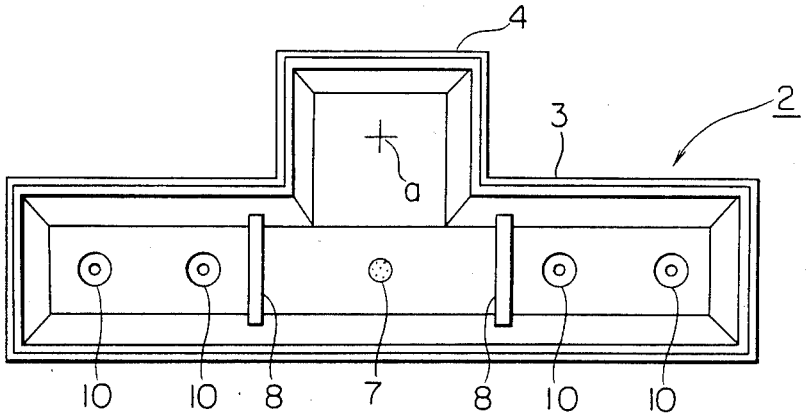
FIG. 4 is a plan view along line X—X of FIG. 3.

FIG. 3 shows another embodiment of the invention, wherein the main body 3 of the tundish is formed with a projecting part 4 (referred to as a T-type tundish hereinafter), and the ladle nozzle 5 is positioned nearly at the center a of the projecting part 4. In this embodiment, the teeming zone of this invention is defined by the position a of the ladle nozzle 5 and the projecting part 4, and the dispersion zone is formed between the dams 8, 8 and a single gas ejector 7.

Figure 5:
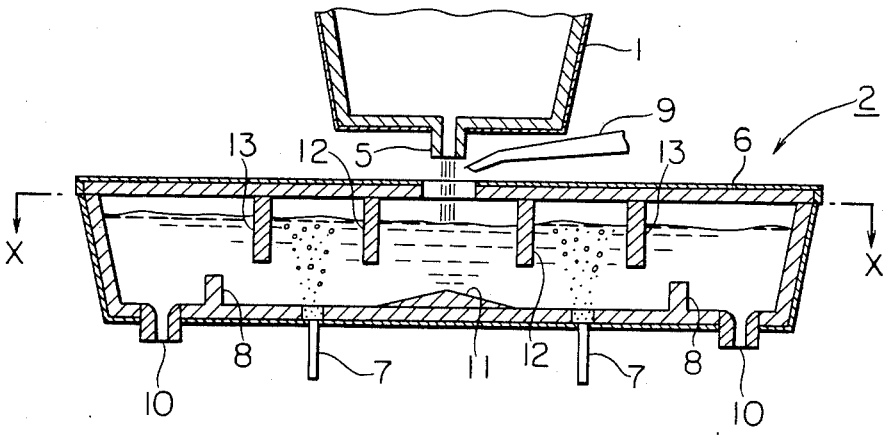
FIG. 5 is a front sectional view of another embodiment of the invention.
Figure 6:
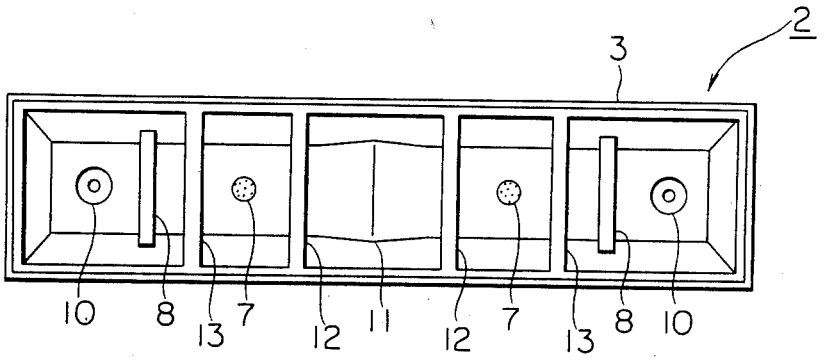
FIG. 6 is a plan view along line X—X of FIG. 5.

FIG. 5 shows another embodiment of the invention, wherein the teeming zone is defined by two inner weirs 12, 12 fixed to the cover 6 so as to enclose the center area of the tundish 2. The molten steel is teemed in the center portion. The reach of inner weirs should be long enough to pass into the molten steel but not so long as to reach the base of the tundish. A convex part 11, high in the middle and tapering off on both sides, is provided within the teeming zone surrounded by the inner weirs.

Two outer weirs 13, 13 are suspended from the cover 6 of the tundish outside the teeming zone, and the gas ejectors 7, 7 are positioned in the bottom of the tundish between the inner weirs 12 and the outer weirs 13.

The gas used is Ar or $N_2$, and the gas ejector is preferably a porous plug. The outer weirs 13 should preferably be about the same length as the inner ones but are still effective even if longer or shorter.

In addition, dams 8, 8 are provided on the bottom of the tundish outside the outer weirs 13, 13. The height of the dams 8, 8 should be less than the depth of the molten steel. The dispersion means is formed by providing the gas ejectors 7, 7 in the regions defined between the inner weirs 12, 12 and the dams 8, 8. Molten steel discharge outlets 10, 10 are positioned outside the dams 8, 8.

The forward tip of the feed pipe 9 is directed to the stream of molten steel passing from the ladle 1 to the tundish 2 and so used to add a low melting metal to the molten steel in the form of a powder.

When the molten steel flows from the ladle into the teeming zone, the powder supplied by the feed pipe 9 is entrained by the descending steel stream due to its falling energy. As the entrained powder is surrounded by the weirs 12, 12, almost none of it floats upward. It is thus transported by the descending stream of molten steel. While being so transported, the powder becomes well dispersed and dissolved. The action of the convex wall 11 at the bottom of the tundish causes the powder, particularly large undissolved particle thereof to move quickly to the dispersion zones.

In the dispersion zones, the molten steel is vigorously stirred by the bubbling action of the gas from the gas ejectors. By such stirring, the powder is dissolved and dispersed in the molten steel.

Since the dispersion zones are surrounded by the inner weirs 12, 12 and the outer weirs 13, 13, the stirring action of the molten steel is accelerated by gas bubbling. Therefore the relatively light undissolved powder particles are entrained by the stream of molten steel while dispersion of the powder particles of relatively high specific gravity into the molten steel is accelerated.

If, for some reason, some part of the powder is neither dissolved nor dispersed in the molten steel, this remaining powder will be prevented from flowing into the continuous casting mold via the discharge outlet 12 of molten steel by the dams 8, 8.

Figure 7:
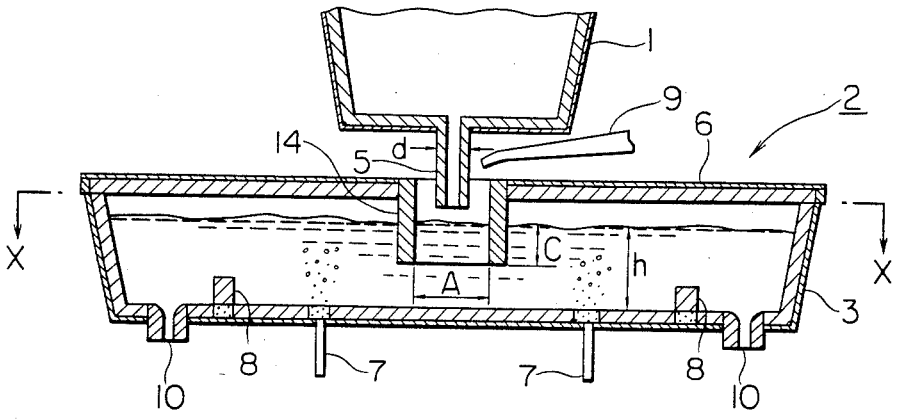
FIG. 7 is a front sectional view of another embodiment of the invention.

Another embodiment of the invention is shown in FIG. 7. In this embodiment, the nozzle 5 is provided under the ladle 1, and a shroud 14 is provided to extend downwardly from the cover 6 of the tundish 2 so as to surround the lower part of the nozzle 5.

Figure 8:
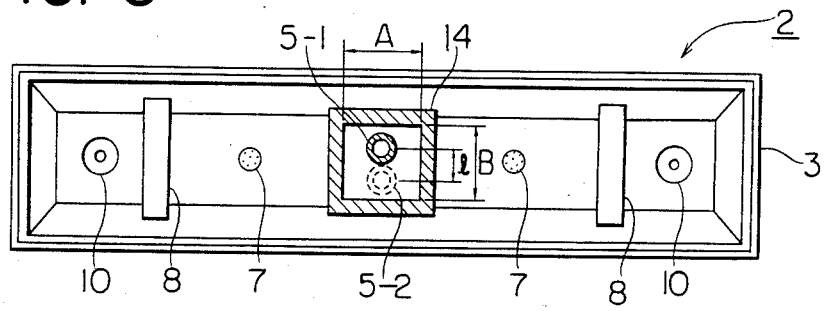
FIG. 8 is a plan view along line X—X of FIG. 7.

The upper end of the shroud 14 is flush with the cover 6. The feed pipe 9 is provided to open into the space between the ladle nozzle 5 and the shroud 14. The lower end of the shroud 14 is immersed into the molten steel in the tundish. As illustrated in FIG. 8, the shroud 14 is of oblong shape in horizontal section and surrounds the ladle nozzle 5. This embodiment has a single gas ejector 7.

Figure 9:
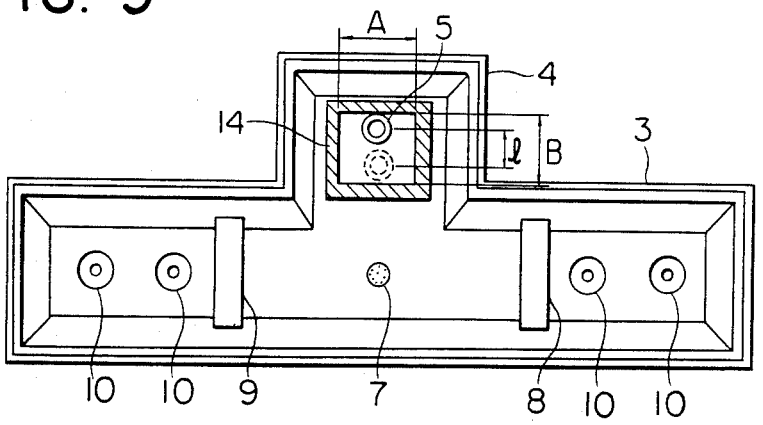
FIG. 9 is a plan view of a modification of the embodiment of FIG. 7.

In FIGS. 8–9, the ladle nozzle 5 is a sliding nozzle movable between two positions 5-1 and 5-2 separated by a distance l. In the case of a stationary nozzle, l=0.

Defining the width and length of the shroud and the depth of immersion thereof in the molten steel in the tundish as A, B and C (all in mm), respectively, the outside diameter and sliding distance of the nozzle as d and l (in mm), respectively, and the depth of the molten steel as h (in mm), the optimum dimensions of the shroud fall within the following range.

$A=(3\sim6)d$ $B=l+100$ mm $C=(0.5\sim0.8)h$

If the above conditions are not satisfied, for instance, if the width A of the shroud should be less than three times the diameter d of the nozzle, the molten steel from the nozzle will spatter on the inside wall of the shroud, increasing the amount of skull adhering thereto and consequently making it impossible to add the powder to the molten steel.

Moreover, if the width A of the shroud exceeds six times the diameter d of the nozzle or the length B of the shroud exceeds l+100 mm, the stirring action of the molten steel in the shroud is so reduced that almost no stirring-in of the powder is attained.

Further, when the depth of immersion C is less than 0.5 times the depth of the molten steel h, the molten steel is dispersed out of the shroud in a short time and, as a result, mixing of the powder into the molten steel is insufficient.

On the other hand, if the depth of immersion C exceeds 0.8 times the depth of molten steel h, the solid powder which has been added, stirred and mixed remains in the shroud for a long time, preventing sufficient diffusion of the powder into the tundish.

With the arrangement according to the present invention described above, when the molten steel in the ladle 1 passes into the tundish 2 via the nozzle 5, the molten steel stream from the nozzle is vigorously stirred within the shroud 14. Therefore, when the powder is added thereto, it is mixed and dispersed in the stirred stream of molten steel, and thereafter the molten steel is dispersed from the bottom of the shroud to the left and right regions of the tundish 2.

Figure 10:
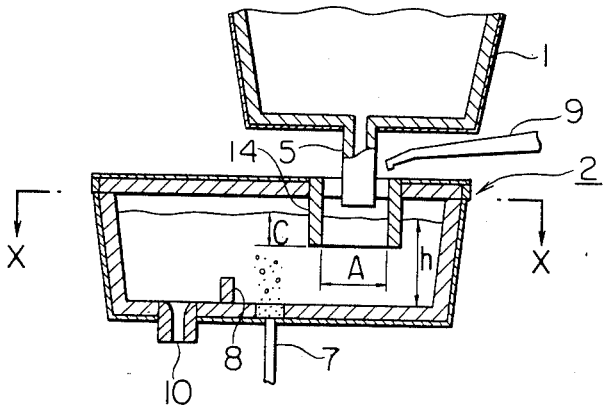
FIG. 10 is a front sectional view of another embodiment of the invention.
Figure 11:
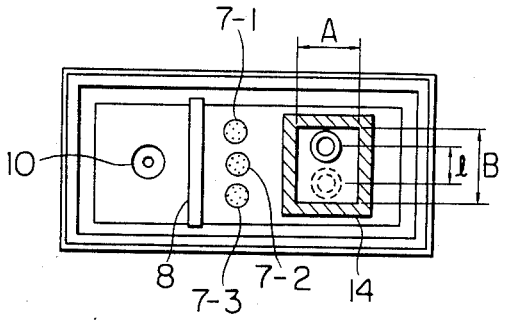
FIG. 11 is a plan view along line X—X of FIG. 10.

While the embodiments of the present invention described in the foregoing are for use with two strands, FIG. 10, 11 depict a tundish of the type shown in FIG. 7 for use with one strand.

FIGS. 12–15 illustrate further embodiments of this invention.

Figure 12:
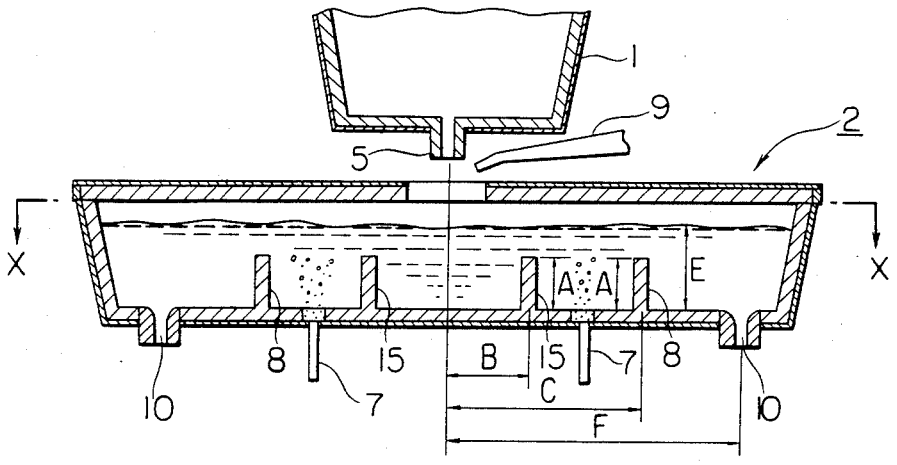
FIG. 12 is a front sectional view of another embodiment of the invention.

In the embodiment shown in FIG. 12, a pair of inner dams 15, 15 and a pair of outer dams 8, 8 are provided on the bottom of the tundish 2. The ladel nozzle 5 is positioned between the inner dams 15, 15, while each outer dam 8 is positioned between one of the inner dams and one of a pair of discharge outlets 10.

Figure 13:
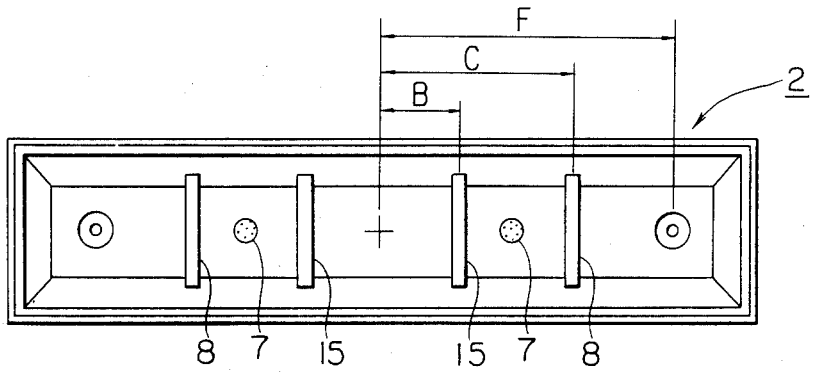
FIG. 13 is a plan view along line X—X of FIG. 12.

As shown in FIG. 13, the inner dams 15, 15 and the outer dams 8, 8 have a length equal to the width of the tundish and are all of approximately the same height. Further, as illustrated in FIG. 12, the height of the dams is less than the depth of the molten steel.

Figure 14:
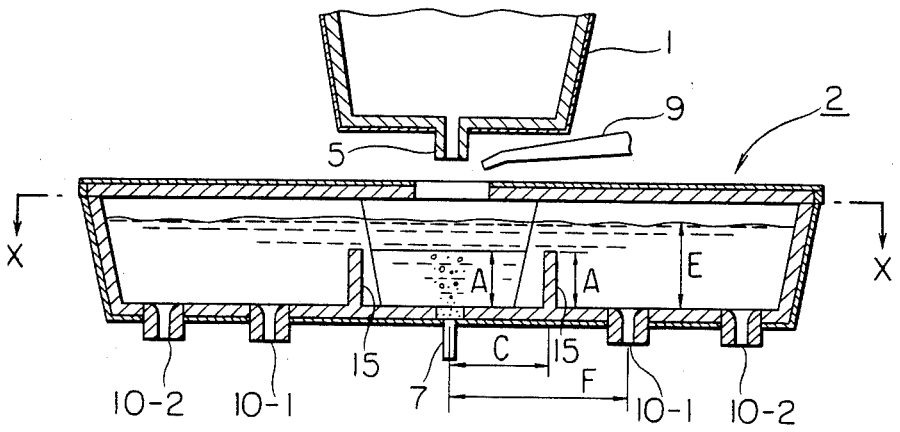
FIG. 14 is a front sectional view of another embodiment of the invention.
Figure 15:
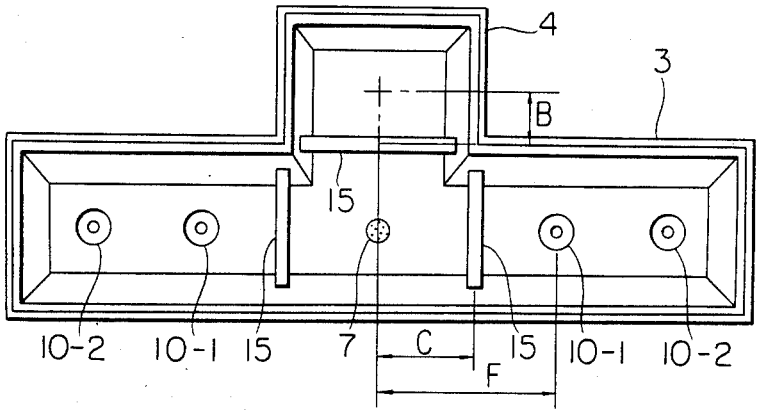
FIG. 15 is a plan view along line X—X of FIG. 14.

FIG. 14 shows a T-type tundish to which the principle of the invention is applied. Here, a third inner dam 15 is provided so as to partition off the projecting part 4 of the tundish.

In the embodiments of FIGS. 12–15, the following relationships should be satisfied.

$A=(0.2\sim0.5)E$ $B=(0.1\sim0.3)F$ $C=(0.4\sim0.6)F$ where A is the height of the inner dams 15, 15 and outer dams 8, 8; B is the distance between each inner dam 15 and the center of the ladle nozzle 5; C is the distance between each outer dam 8 and the center of the ladle nozzle 5; E is the depth of the molten steel; and F is the distance between the center of the ladle nozzle 5 and each discharge outlet 10-1 nearer to the center of the tundish.

If the height A of the inner and outer dams 15, 15 and 8, 8 is higher than that defined above, the molten steel will be retained for a longer time than required so that the powder once uniformly dispersed in the molten steel will settle and accumulate on the bottom of the tundish. Conversely, if the height A is lower than defined, undissolved powder will flow into the discharge outlets 10-1 and 10-2.

If the distances B and C are too great, the molten steel will be retained for a longer time than required, and if too small, undissolved powder will escape.

In these embodiments, the molten steel from the ladle nozzle 5 temporarily remains within the inner dams 15, 15 and then overflows these dams to be temporarily retained within the outer dams 8, 8. Thereafter it is supplied into the mold via the discharge outlets 10, 10. At this time, undissolved powder is prevented from flowing into the discharge outlets 10, 10 by the inner dams 15, 15 and the outer dams 8. 8. In this embodiment, the outer dams 8, 8 play the role of the dams 8, 8 in FIG. 1.

Still another embodiment of the invention will be described in connection with FIGS. 16–19.

Figure 16:
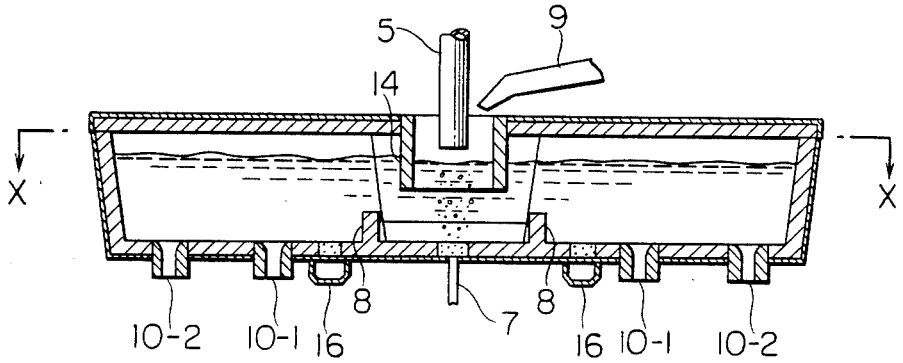
FIG. 16 is a front sectional view of still another embodiment of the invention.

FIG. 16 depicts an embodiment in which a gas ejector 7 is provided in the center portion between the dams 8, 8 and passage zones 16, 16 for the low melting metal are provided downstream of the dams 8, 8. In the respective drawings, the same numerals are used to indicate the same means.

Experiments show that in the continuous casting of steel containing a low melting metal, such as Pb or Bi, which has a greater specific gravity and a lower melting point than steel, if the low melting metal remains in the molten steel for a prolonged time, it becomes impossible to prevent its penetration and passage through of the pores and joints of refractory bricks of the type now in general use in the industry.

After the use, the inventors examined tundish bricks which had been in use for a long time and found that Pb or Bi had passed through the joint of the tuyere of the nozzle, the upper tuyere, the lower tuyere and the upper nozzle and their pores, and had flown into the nozzle, resulting in the formation of huge Pb or Bi.

Figure 17:
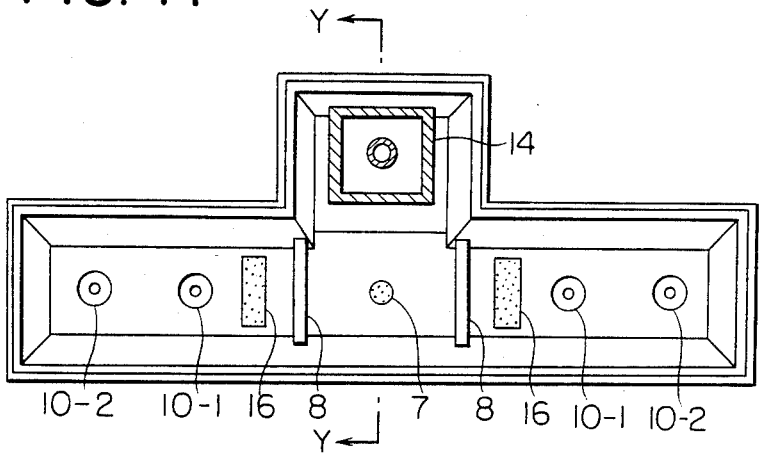
FIG. 17 is a similar plan view along the line X—X of FIG. 16.
Figure 18:
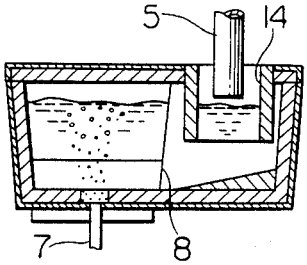
FIG. 18 is a similar plan view along the line Y—Y of FIG. 17.

FIGS. 16, 17 and 18 show the structure of a tundish designed to cope with this phenomenon.

As an effective means for preventing the flow of settled low melting metals into the discharge outlet for the molten steel, a passage zone 16 comprising porous bricks, slotted safety bricks, and a slotted steel jacket is provided downstream of each of a pair of dams.

Figure 19:
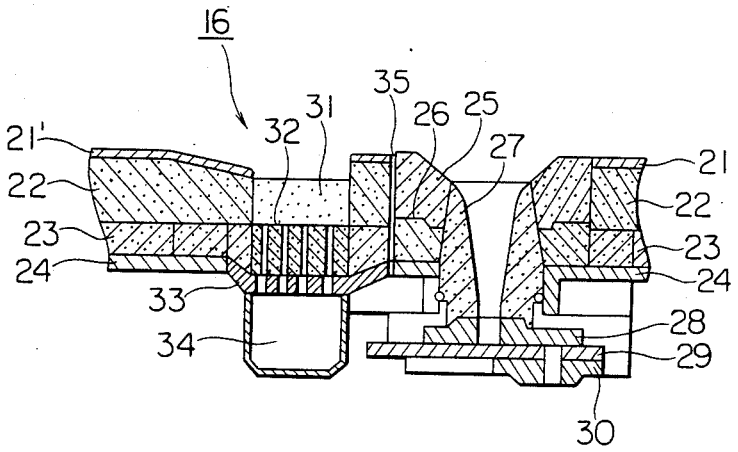
FIG. 19 is a partial enlarged view of the invention.

FIG. 19 shows an enlarged view of the passage zone for undissolved powder. This passage zone is provided between an upper nozzle 27 constituting a part of a discharge outlet 10 and the position at which the molten steel is poured into the tundish and comprises porous brick 31, slotted safety brick 32 and a slotted steel jacket 33 instead of wear brick 22, safety brick 23, and a steel jacket 24.

The top face of the porous brick 31 is a little lower than the top face of the wear brick 22, while the top face of the wear brick 22 and the coating material 21' thereon are inclined by such an angle that the undissolved powder remaining on the bottom of the tundish will be easily settled into the porous brick 31. The safety brick 32 is fixed in place between the porous brick 31 and the steel jacket 33 by making use of safety brick with upper and lower slots. It is preferred that the steel jacket 33 is positioned at a lower level than the steel jacket 24 so that the undissolved powder which has penetrated between the safety brick 23 and the steel jacket 24 can easily pass therebetween. A pool box 34 for holding the undissolved powder of low melting metal is provided under the steel jacket 33.

The penetrating undissolved powder is prevented from moving toward the upper nozzle 27, and is carried to enter the pool box 34 by a steel seal plate 35 provided between the porous brick 31, the safety brick 32, the steel jacket 33 and the upper nozzle 27.

The lengths of the porous brick 31, the safety brick 32, and the steel jacket 33 are preferred to be 0.1–1.0 times the width of the tundish around the upper nozzle 27 in the width direction of the tundish.

The porous brick 31 may be of the ordinary kind which easily passes gas but is resistant to the penetration of molten steel. The undissolved powder will easily penetrate the porous brick and collect in the pool box.

In the embodiment shown in FIG. 16, the stream of molten steel from the ladle is prevented from passing directly toward the upper nozzle 27 shown in an enlarged view in FIG. 19 by the shroud 14 and the dams 8, 8 and the undissolved powder segregated from the molten steel settles on the bottom of the tundish. A small aperture is made at the bottom of each dam 8, and the undissolved powder which has settled on the bottom of the tundish passes through the small aperture and moves nearer the upper nozzle 27. In FIG. 19, the undissolved powder which has passed through the dam 8 is carried to the porous brick 31 along the top face of the inclined coating material 21'. The undissolved powder then passes through the porous brick 31, the safety brick 32 and the steel jacket 33 and is collected in the pool box 34. The steel seal plate 35 for preventing the undissolved powder from being discharged with the molten steel is provided around the upper tuyere 25 and a lower tuyere 26 in order to completely prevent the undissolved powder from entering the upper nozzle 27. Alternatively, the steel seal plate 35 may be positioned between the upper nozzle 27 and upper and lower tuyeres 25, 26.

For collecting the undissolved powder continuously, it is possible to provide outside heating means on the steel jacket 33 and on the pool box 34. When no heating means are provided, the undissolved powder is collected after completion of casting by removing the pool box 34 from the machine.

The top face of the porous plug is positioned at a lower level than the upper tuyere 25 to prevent Pb on the porous brick 31 from overflowing the top face of the tuyere owing to the weak metal flow from the small aperture of the dam 8.

Recovery means for the undissolved powder, consisting of the inclined coating material 21', the porous brick 31, the safety brick 32, the steel jacket 33, the pool box 34, and the steel seal plate 35 can also be provided with good effect at other positions on the bottom of the tundish.

We claim:

1. A tundish for the continuous casting of a free-cutting steel, said tundish comprising a covered vessel having a top portion, a bottom portion and side portions, said top portion having an inlet for the addition of molten steel and a powdered low melting machinability element, said bottom portion having in sequence, downstream of a point exactly below said inlet, at least one gas ejector means, at least one upwardly projecting dam means and at least one outlet, said gas ejector means adapted to disperse said powdered low melting machinability element in said molten steel, said dam means adapted to prevent undissolved powdered low melting machinability element from flowing from said outlet.

2. The tundish as claimed in claim 1 in which two weirs project downwardly from said top portion, the first of said weirs being upstream of a point exactly above said gas ejector and the second of said weirs being downstream of a point exactly above said gas ejector but upstream of said dam.

3. The tundish as claimed in claim 1 in which a convex projection tapering in the downstream direction provided in the bottom portion exactly below said inlet.

4. The tundish as claimed in claim 1 wherein a downwardly extending shroud is provided around said inlet in said top portion, said shroud being adapted to extend into the molten metal but not to the bottom of said tundish.

5. The tundish as claimed in claim 1 in which said dam means comprises dual projections forming an inner dam and an outer dam, whereby settled low melting metal is prevented from flowing into said outlet for said molten steel.

6. The tundish as claimed in claim 1 in which a passage zone for said low melting metal comprises a plural layered construction of porous brick, safety brick with slits, and steel jacket with slits in order from the top layer thereof and being provided downstream said dam.

* * * * *